US010030947B1

(12) United States Patent
Herring

(10) Patent No.: US 10,030,947 B1
(45) Date of Patent: Jul. 24, 2018

(54) NOCK FOR SLINGSHOT AND SLINGBOW PROJECTILE

(71) Applicant: Bohning Company, LTD, Lake City, MI (US)

(72) Inventor: Jon Herring, Reed City, MI (US)

(73) Assignee: BOHNING COMPANY, LTD, Lake City, MI (US)

( * ) Notice: Subject to any disclaimer, the term of this patent is extended or adjusted under 35 U.S.C. 154(b) by 0 days.

(21) Appl. No.: 15/485,354

(22) Filed: Apr. 12, 2017

(51) Int. Cl.
*F42B 6/06* (2006.01)
*F41B 3/02* (2006.01)

(52) U.S. Cl.
CPC . *F42B 6/06* (2013.01); *F41B 3/02* (2013.01)

(58) Field of Classification Search
CPC ..... F42B 6/06; F41B 3/02
See application file for complete search history.

(56) References Cited

U.S. PATENT DOCUMENTS 5,094,464 A * 3/1992 Musacchia, Sr. ..... A01K 81/04 403/349
5,306,019 A * 4/1994 Guest ..... F42B 6/06 403/349
5,306,020 A * 4/1994 Bolf ..... F42B 6/06 473/578
8,622,855 B2 * 1/2014 Bednar ..... F41B 5/1415 473/578
9,746,294 B2 * 8/2017 Palomaki ..... F42B 6/06
2017/0234661 A1 * 8/2017 Boretto ..... F42B 6/04 473/578

* cited by examiner

*Primary Examiner* — John Ricci
(74) *Attorney, Agent, or Firm* — Smith Tempel Blaha LLC; Gregory Scott Smith

(57) ABSTRACT

A nock or an arrow with a nock suitable for being launched with a slingshot or slingbow. The nock includes a shank that is of sufficient length to fit within the pocket of a slingbow without interfering with the fletching. The nock also includes a flared element to facilitate gripping of the nock. The nock can include a connection shaft for attachment to the shaft of an arrow.

17 Claims, 11 Drawing Sheets

1100

NOCK FOR SLINGSHOT AND SLINGBOW PROJECTILE

BACKGROUND

The cover of the Sep. 16, 1916 issue of The Saturday Evening Post displayed a Norman Rockwell painting that has become a classic and is known as Redhead Loves Hatty Perkins. The picture includes a young redheaded boy dragging his books behind him as he discovers that someone has chalked the words "Redhead loves Hatty Perkins" on the fence. He stands there with a clinched fist and hanging out of the back of his pocket is nothing other than a slingshot.

The slingshot, also called a catapult in the UK, a ging in Australia, kattie in South Africa, bean shooter, flip or tirador, really only came into existence in the 1800's, well after firearms and bow and arrows. This may seem surprising but the slingshot includes one element that was not introduced until 1839—which is vulcanized rubber developed by Charles Goodyear. As most will appreciate, a slingshot is a small, Y-shaped frame held in the hand with two natural-rubber or elastic strips attached to the uprights. The other ends of the elastic strips lead back to a pocket that holds the projectile. The other hand is used to grasp the pocket and draw it back to the desired extent to provide power for the projectile—up to a full span of the arm with sufficiently long bands.

By 1860, the slingshot had gained a reputation as a juvenile weapon but they have also been used for hunting small game. For much of their early history, slingshots were a "do-it-yourself" item, typically made from a forked branch to form the "Y" shaped handle, with rubber strips sliced from items such as inner tubes or other sources of good vulcanized rubber and firing suitably sized stones, lead musket balls, buckshot, steel ball bearings, air gun pellets or small nails. As a hunting weapon, slingshots are suitable for taking game such as quail, pheasant, rabbit, dove, and squirrels. Placing multiple balls in the pouch produces shotgun type effect, such as firing multiple BB or pellets at a time for hunting small birds. With the addition of a suitable rest, the slingshot can also be used to shoot arrows or bolts, allowing the hunting of medium-sized game at short range. When used for firing arrows or bolts, the slingshot is more typically referred to as a slingbow.

The slingbow has some advantages over a traditional bow and arrow. One such advantage is that the slingbow is much smaller than a traditional bow or cross bow. The slingbow can easily be stored in a pocket or backpack. Thus, the slingbow allows a hunter to move more freely, especially in tight spots or wooded locations with many branches that may snag on the bow. In addition, because the slingbow uses rubber bands or strips as the source of power rather than the intrinsic tension of a length of wood, it is more suitable for a do-it-yourself repair if the bands break. It's also possible to increase the power and speed of the arrow in flight by adding multiple numbers of bands. A traditional bow has a fixed power granted to it by the length and type of wood used in the construction and the arm length of the archer to some extent. As such, slingbow hunting, fishing and simple target shooting and competition has found a market for the hunter and sportsman. However, what is needed in the art is a nock that is suitable for arrows and bolts that are being shot from a slingbow. Such a nock can improve the reliability, ease of use and safety of shooting projectiles with a slingbow.

BRIEF SUMMARY

Various embodiments of the present invention includes a nock or an arrow with a nock suitable for being launched with a slingshot or slingbow. The nock includes a shank that is of sufficient length to fit within the pocket of a slingbow without interfering with the fletching. The nock also includes a flared element to facilitate gripping of the nock. The nock can include a connection shaft for attachment to the shaft of an arrow.

One embodiment of the nock includes a connection shaft, a shank that is coaxially aligned with the connection shaft and that extends from a first end of the shank and a flare that extends from a second end of the shank. The flare is located on the opposite end of the shank from the connection shaft. In some embodiments, the connection shaft has a smaller diameter than the shank and is configured to be inserted into the interior of a projectile shaft. In some embodiments, the connection shaft has a diameter configured to allow the connection shaft to be inserted into an interior of a projectile shaft. In some embodiments, a ridge or ledge is located or positioned between the connection shaft and the shank to operate as a stop when sliding the connection shaft into the interior of the projectile shaft.

In some embodiments of the nock, the surface of the connection shaft includes one or more raised surfaces to bind the connection shaft against the interior surface of the projectile shaft. In some embodiments, the raised surfaces on the connection shaft may be ridges that extend laterally over a significant portion of the length of the connection shaft. In other embodiments, the raised surfaces may be ridges that extend over the surface of the connection shaft in a threading manner. In yet other embodiments of the nock, the raised surfaces to bind the connection shaft against the interior surface of the projectile shaft may simply be bumps or protrusions. Other embodiments may use a glue or adhesive to attach the nock, was well as a combination of two or more of these techniques and others.

Some embodiments may be utilized with take-down arrows. In such embodiments, the nock can be held in place tightly against the end of the arrow shaft by a knot tied at the end of an elastic cord that runs through the hollow nock and axially down the length of the shaft. This embodiment is advantageous for use in take-down arrow setups where the elastic cord holds all of the arrow components together, much like a collapsible tent pole.

In some embodiments of the nock, the length of the shank is sufficiently long such that it can be held between the fingers and held in the pocket of the slingbow without causing damage to or interfering with the fletching. In some embodiments, the shank includes a plurality of raised surfaces to provide grip friction.

In the various embodiments, the nock includes a flare that is configured to operate as a grip stop for holding the projectile. Thus, when the nock is gripped in the pocket, as the user draws back, the flared element helps the user to hold onto the arrow without misfiring. In some embodiments, the flared element includes a plurality of wings extending in a generally outward direction from the surface of the shank. Further, in some embodiments, the flare is tapered out from the surface of the shank. In some embodiments, the flared element may include a slot configured to receive a traditional bow string.

In various embodiments, the nock may be attached to the arrow shaft or, the arrow shaft may have the nock built in to it. As such, in some embodiments the nock is configured to be attached to the projectile using adhesive, screws, pins, using mating threads, tape, welding, crimping, elastic band (for instance in take-down arrows), and/or friction, as well as any combination of such techniques and others.

Some embodiments include an arrow along with a slingbow nock. In such embodiments, the arrow or bolt (referred to as a projectile) includes a shaft with a load at one end of the projectile shaft and a fletching attached proximate to a second end of the projectile. The nock extends from the second end of the projectile shaft. The nock includes a shank that is coaxially aligned with the projectile shaft and having a length extending beyond the fletching and a flare that extends from the end of the shank that is distal from the arrow shaft. The various embodiments may be used in any slingbow application including, but not limited to, hunting, target shooting, survival, fishing and recreational shooting. In some embodiments, the nocks may be used in the point or load end of the arrow in a survival situation requiring improvised blunt points for small game or fish. The various embodiments may be constructed from plastic injection molded using durable polymers or composites, machined or die cast in various metals and other materials.

These and other embodiments, aspects, features and elements are presented in greater detail along with the accompanying drawings in the detailed description that follows.

DETAILED DESCRIPTION

The present invention, as well as features and aspects thereof, is directed towards providing a nock design for slingbows or slingshots, and more particularly, a nock that is configured to facilitate being shot from a slingbow or slingshot.

Figure 1:
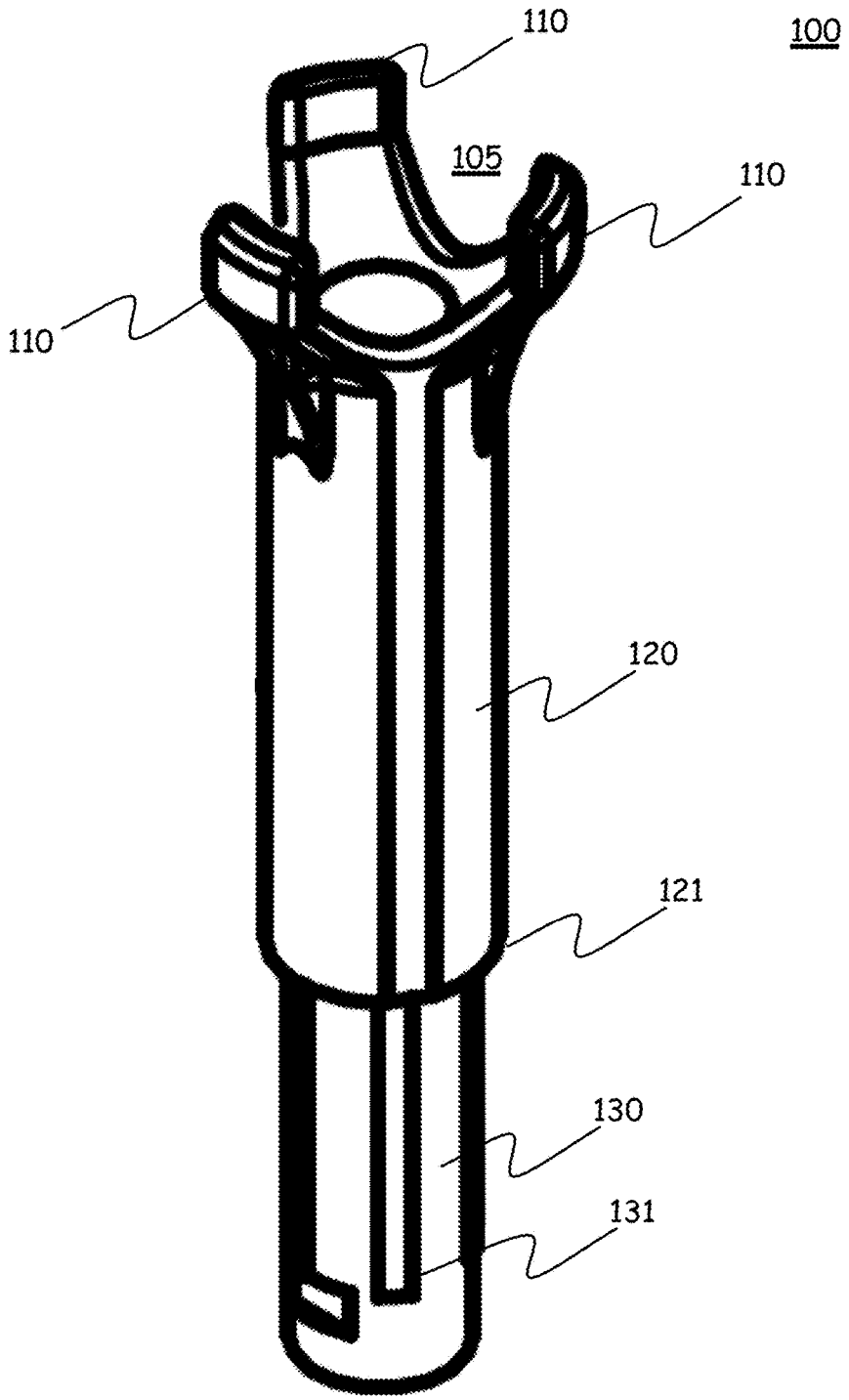
FIG. 1 is a perspective view of an exemplary embodiment of a slingbow nock.

FIG. 1 is a perspective view of an exemplary embodiment of a slingbow nock. The illustrated nock 100 includes a shank 120.

On one end of the shank 120, the nock 100 includes a flared or bulging element 105. The purpose of the flared element is to provide a stop, grip, nodule, bulb etc. that facilitates gripping of the nock 100 when an arrow or bolt is being loaded for shooting. In the illustrated embodiment in FIG. 1, the flared element 105 includes three flanges 110 that extend outward from the surface of the shank 120. The flanges 110 can be of a variety of shapes and configurations. In the illustrated embodiment, the flanges 110 taper outward and backwards at an angle, such as a 45-degree angle, from the surface of the shank for a first distance, and then curves or turns to extend backwards and parallel from the shank 120. However, it should be appreciated that a variety of structures could be utilized such as the flanges 110 curving or arching out from the surface of the shank 120, only angling outwards and not turning, angling outwards at more obtuse or more acute angles, etc. The overall diameter of the flared element 105 is generally larger than the diameter of the shank 120 and in the various embodiments, the flared element 105 is of sufficient diameter to allow adequate grip when held in the pocket of the slingbow or slingshot. As a non-limiting example, the diameter of the flared element 105 may be 1.5 to 2.5 times the diameter of the shank 120, however, it should be appreciated that other diameters are also anticipated. It may also be appreciated that the diameter of the shank 120 may be reduced proximate to the flared element 105 to create more disparity in the diameter of the flared element 105 and the shank 120 at the location where the nock 100 is being held. It is preferable that the flared element 105 is structured to minimize the amount of resistance when the passing through a whisker biscuit or similar type of supporting rest, as well as reducing wind resistance, however, non-optimal configurations are also anticipated by this disclosure.

The shank 120 is of sufficient length to allow a user to pinch the shank 120, or hold the shank 120 between either the user's thumb and index finger or between two other fingers, such as the index and middle finger. In some embodiments the shank may be as long as 2 inches or as short as 0.5 inches as a non-limiting example. Other lengths are also anticipated. In any variation, the space between the flared element 105 and the distal end of the shank 120 should be of sufficient length to allow for a firm grip in the pocket of the slingbow without damaging or crushing the fletching of the arrow. For a manual release, in which the shank 120 is pinched between the fingers of an archer, the described lengths of 0.5 to 2 inches should be sufficient but, other lengths may also be utilized. In other embodiments, a mechanical release may be utilized and in such embodiments, the length of the shank 120 may be shortened.

On the other end of the shank 120, distal from the flared element 105, the nock 100 includes a connection shaft 130. The connection shaft 130 extends from the shank 120 and is coaxially aligned with the shank 120. The purpose of the connection shaft 130 is to mate with and attach to the shaft of an arrow or bolt. In some embodiments, the connection shaft 130 may have a diameter that is suitable for being inserted into the interior portion of a hollow arrow shaft. In other embodiments, the connection shaft 130 may be designed as a sleeve that slips over the outside of the arrow shaft. In any such embodiments, the connection shaft 130 should be configured to securely connect or attach to the arrow shaft. In the illustrated embodiment, the connection shaft 130 has a diameter that is less than the diameter of the shank 120. Thus, in such an embodiment, the connection shaft 130 can be sized to slide within the interior of an arrow shaft. Preferably, the arrow shaft has the same diameter as the shank 120. In such an embodiment, the connection shaft 130 can be slid into the interior of the arrow shaft up to the edge 121 defined by the transition from the lesser diameter of the connection shaft 130 to the larger diameter of the shank 120. The length of the connection shaft 130 may vary but it should be long enough to provide a secure and stable connection with the arrow shaft. As a non-limiting example, the connection shaft 130 may be between 0.5 and 2 inches but, other lengths are also anticipated.

In some embodiments, the connection shaft 130 may be affixed within the interior of the arrow shaft or on the exterior of the arrow shaft using a variety of adhesives. It is anticipated that other connection means may also be utilized including screws, pins, tape, wraps, heat shrinks etc. In addition, friction may be used in lieu of or in addition to any of the afore mentioned methods as well as others.

In the embodiment illustrated in FIG. 1, a ridge 131 extends along a portion of the surface of the connection shaft 130. The ridge 131 is slightly raised above the surface of the connection shaft 130 and creates pressure against the inner side wall of the arrow shaft when inserted. The connection shaft 130 may include a plurality of such ridges to create a strong frictional hold of the nock 100 to the arrow. Rather than a ridge, a plurality of nodules or protrusions may also be utilized. In some embodiments, protrusions from the surface of the connection shaft 130 may mate or correspond with detents within the interior of the arrow shaft or holes or apertures in the arrow shaft. Thus, the protrusions would slide into the detents, holes or apertures to further provide connection support between the nock 105 and the arrow shaft. Other configurations are also anticipated such as a twist and lock type configuration. Further, in some embodiments once the connection shaft is inserted, the arrow shaft can be crimped to hold the nock 105 in position. Still further, in some embodiments the connection shaft 130 may include a threaded ridge that can be screwed into the interior shaft of the arrow. In yet other embodiments, the arrow shaft interior may also include threads for receiving a threaded connection shaft. In yet other embodiments, an insert may be glued or otherwise connected within the interior of the arrow shaft for receiving a threaded connection shaft 130. It should be appreciated that each of the connection techniques described here in, as well as other techniques can be used for connection shafts that attach to the exterior of the arrow shaft as well.

Figure 2:
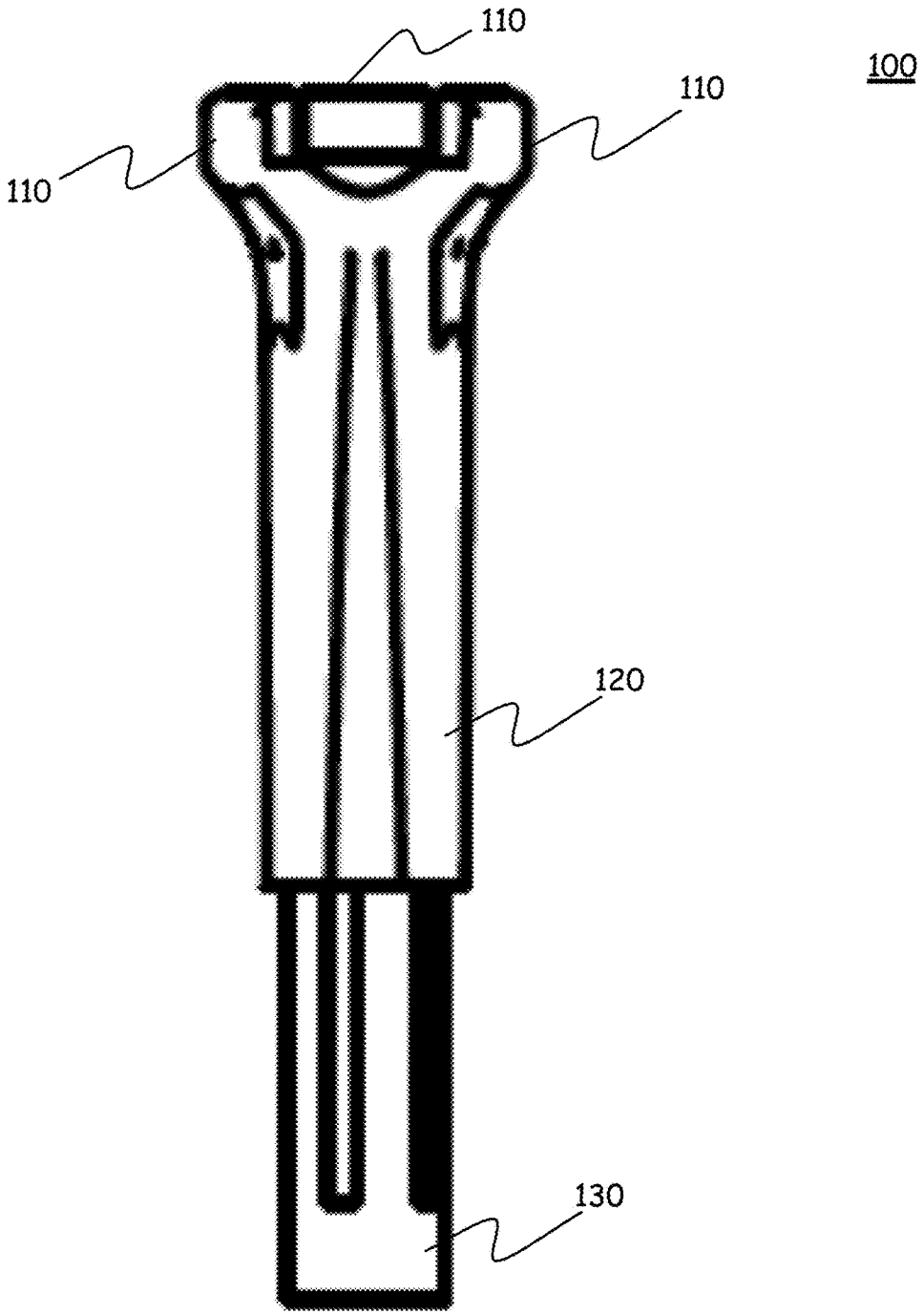
FIG. 2 is a side elevation view of the slingbow nock of FIG. 1.

FIG. 2 is a side elevation view of the slingbow nock of FIG. 1. From this view it is clear that the flanges 110 taper upwards and outward for a first distance, and then turn to run substantially parallel to the surface of the shank 120. It should be appreciated that although the shank 120 is shown as being of substantially uniform diameter, it may be tapered or grooved as well. And as previously mentioned, the shank 120 may be tapered or have a reduced diameter near the flared element 105.

Figure 3:
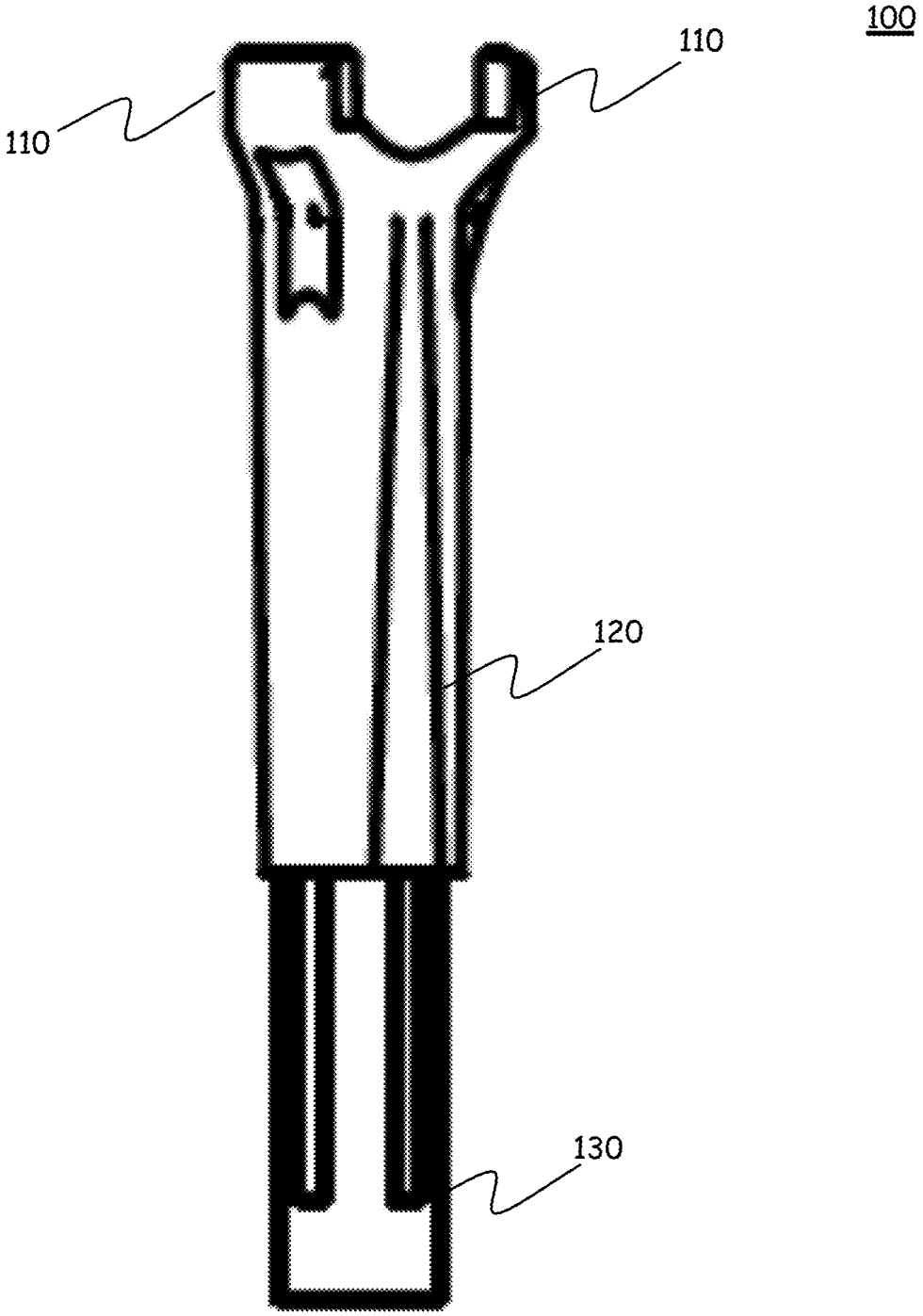
FIG. 3 is a side elevation view of the slingbow nock of FIG. 1, rotated from the view shown in FIG. 2.

FIG. 3 is a side elevation view of the slingbow nock of FIG. 1, rotated from the view shown in FIG. 2. From this view it is clear that the flanges 110 include gaps between them. These gaps may help to reduce resistance when passing through the whisker biscuit or the air but may also be used for as a normal nock slot for shooting the arrow or bolt with a traditional bow or crossbow. Thus, the string may be inserted in the gaps between the flanges 110.

Figure 4:
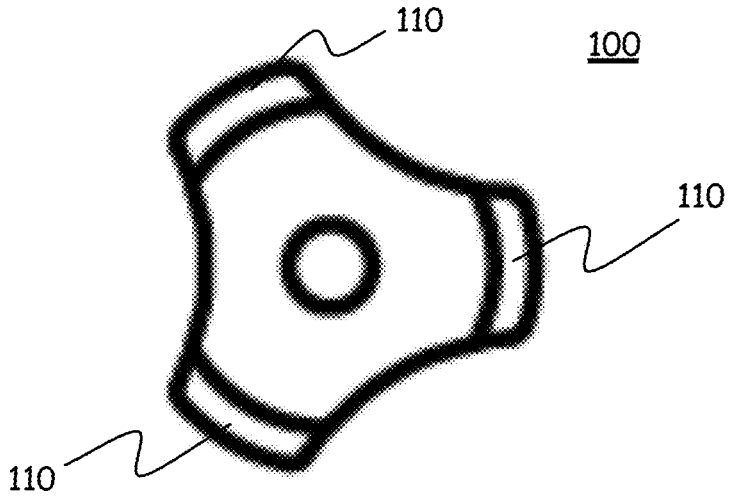
FIG. 4 is top planer view of the slingbow nock of FIG. 1.
Figure 5:
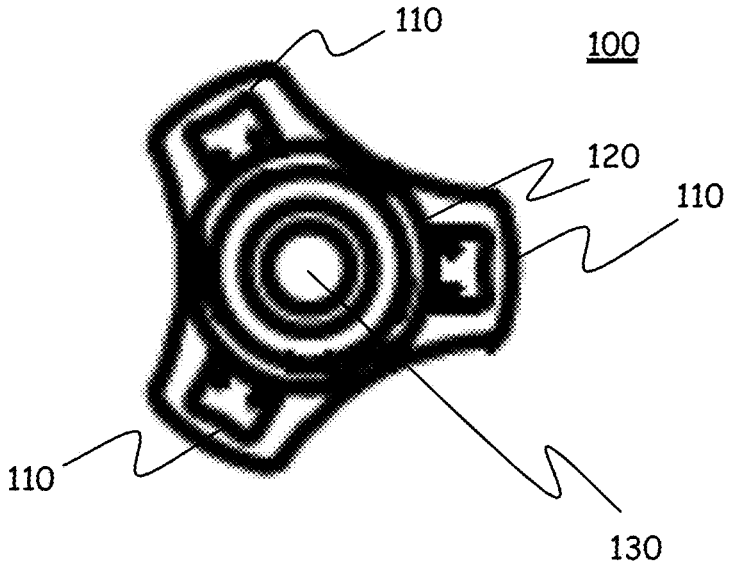
FIG. 5 is a bottom plan view of the slingbow nock of FIG. 1

FIG. 4 is top planer view of the slingbow nock of FIG. 1 and FIG. 5 is a bottom plan view of the slingbow nock of FIG. 1.

Figure 6:
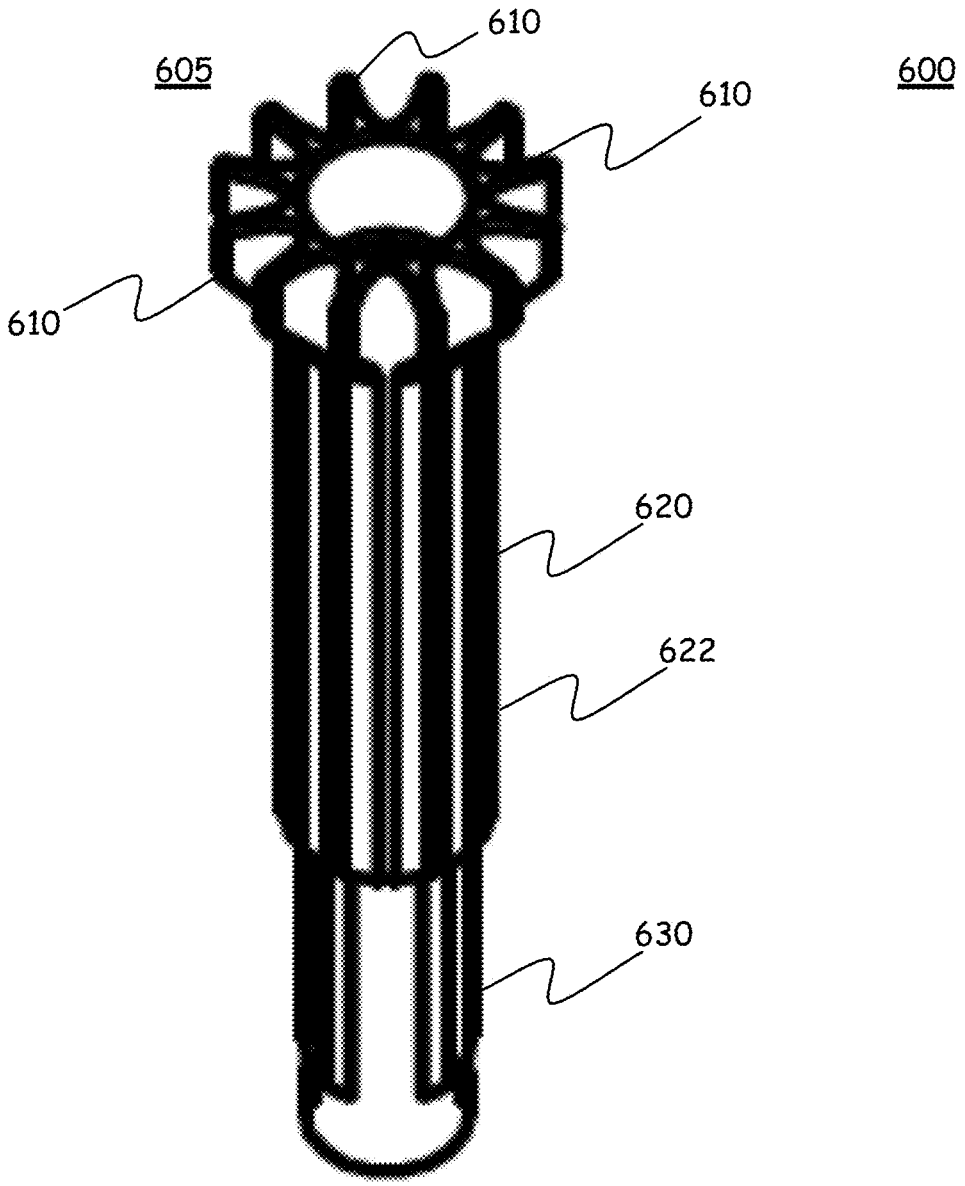
FIG. 6 is another exemplary embodiment of the slingbow nock.

FIG. 6 is another exemplary embodiment of the slingbow nock. In this embodiment, the nock 600 includes a shank 620 and a connection shaft 630. The flared element 605 in this embodiment includes 12 flanges 610 and is more akin to looking like a gear. In this embodiment, the flared element 605 is more substantial and may better facilitate a grip. Also illustrated here and elsewhere, the shank 620 includes a plurality of ridges that can also help to grip the nock within the slingbow pocket. It should be appreciated that vertical, horizontal, and various other configurations of ridges, grooves or both could be used to help improve gripping of the nock.

Figure 7:
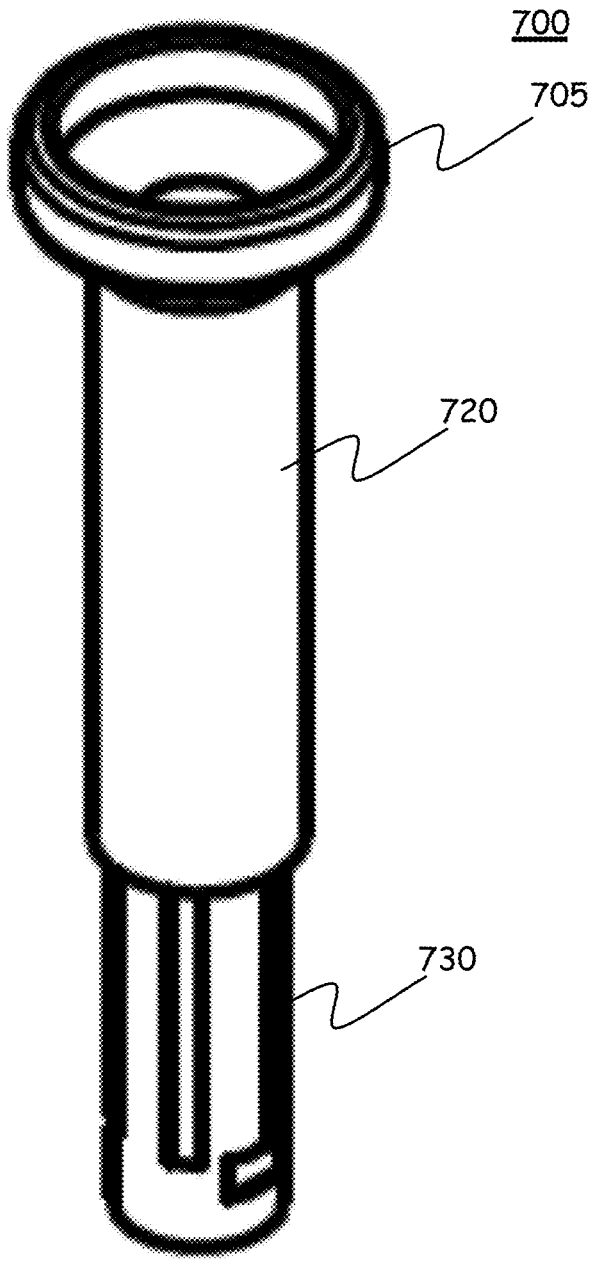
FIG. 7 is yet another exemplary embodiment of the slingbow nock.

FIG. 7 is yet another exemplary embodiment of the slingbow nock. In the illustrated embodiment, the nock 700 includes a bowl shaped flared element 705, shank 720 and connection shaft 730. In the illustrated embodiment, a slot can be inserted in the opposing sides of the bowl-shaped flared element 705 to receive a string from a regular bow.

Figure 8:
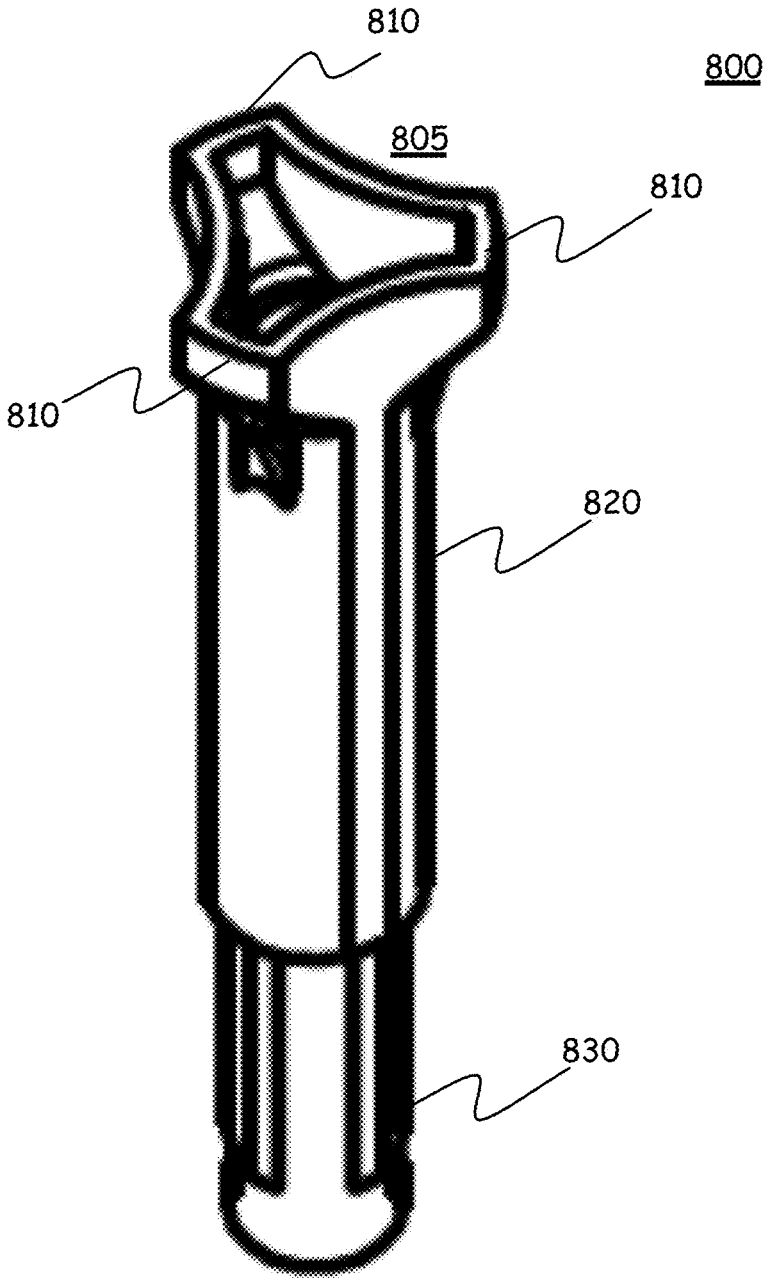
FIG. 8 is yet still another exemplary embodiment of the slingbow nock.

FIG. 8 is yet still another exemplary embodiment of the slingbow nock. In the illustrated embodiment, the nock 800 includes a shank 820 and connection shaft 830. The flared element 805 is a hybrid between the flanges 110 in FIG. 1 and the bowl-shaped flared element 705 of FIG. 7. Here, the flared element 805 includes three protruding portions 810 as though the edges of a bowl were pinched inward.

Figure 9:
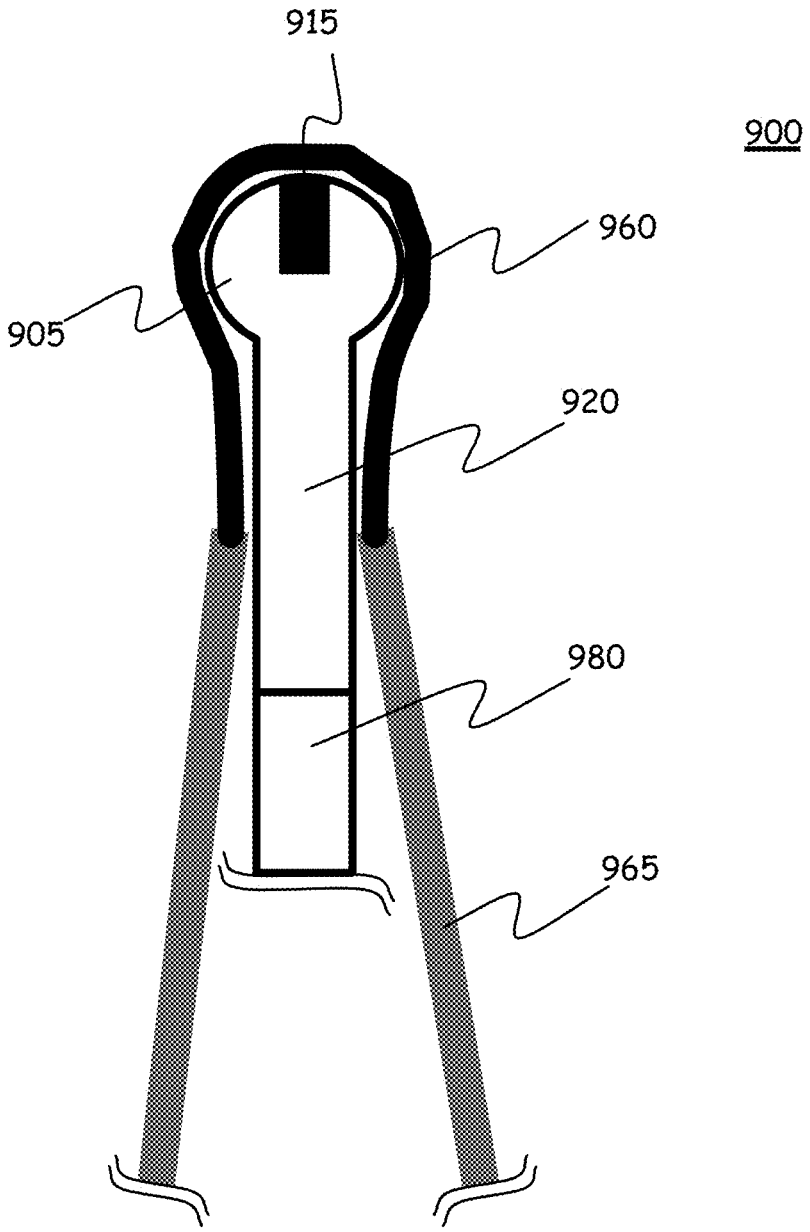
FIG. 9 is even still another exemplary embodiment of the slingbow nock illustrated as being installed in the pocket of the slingbow.

FIG. 9 is even still another exemplary embodiment of the slingbow nock illustrated as being installed in the pocket of the slingbow. In the illustrated embodiment, the nock 900 includes a flared element 905 that is substantially round, similar to a ball, attached to the end of the shank 920. The nock 900 is illustrated as being attached to arrow 980. The flared element 905 optionally includes a slot or groove 915 to facilitate use of the nock 900 with a standard bow. FIG. 9 further illustrates a pocket 960 in which the flared element 905 rests. Attached to the ends of the pocket 960 is illustrated elastic bands 965 that attach to the slingbow (not illustrated). The pocket 960 is shown as encompassing the flared element 905 and an archer can pinch the pocket 960 when drawing the arrow backwards for launching.

Figure 10:
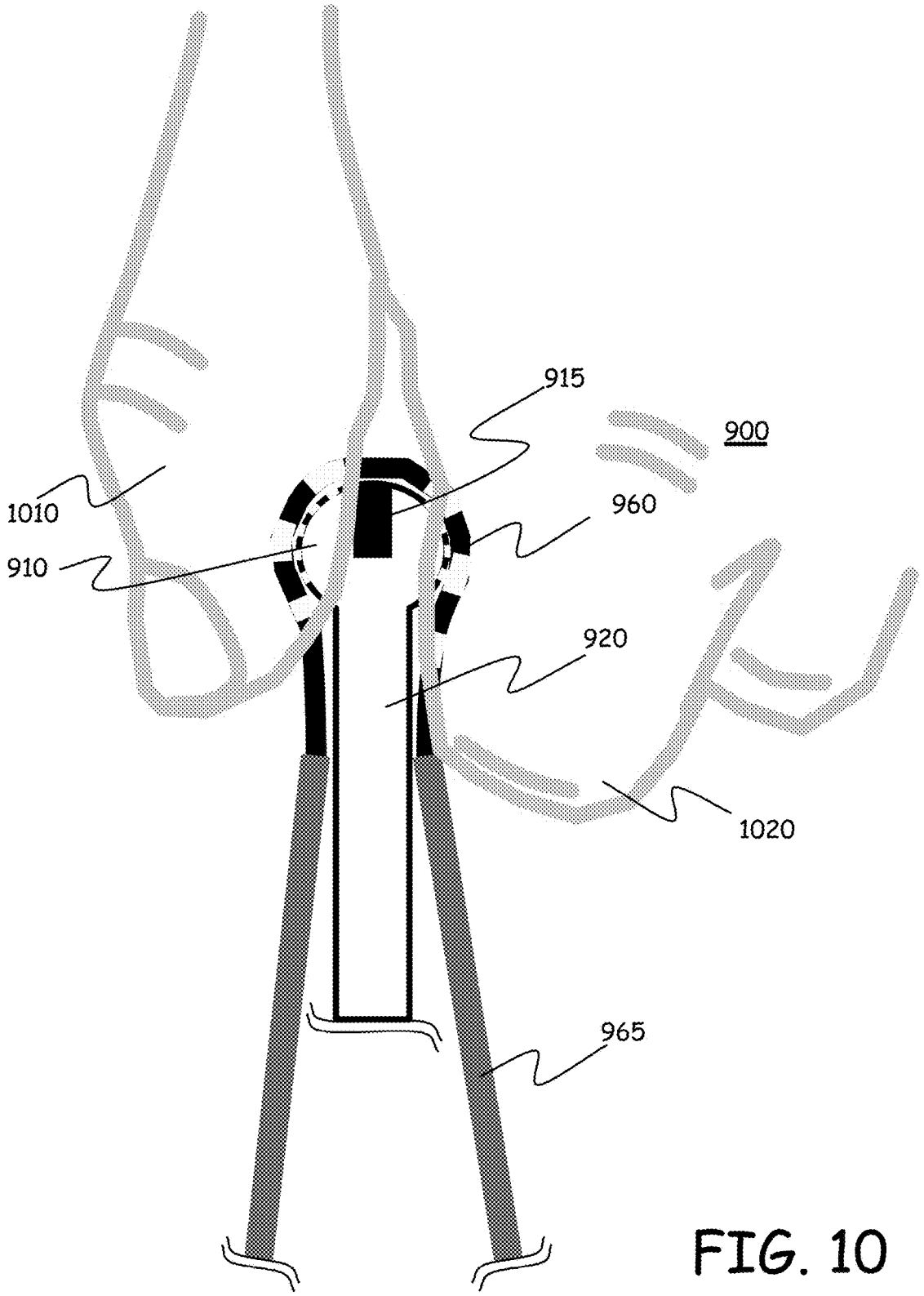
FIG. 10 is a diagram of an exemplary slingbow nock installed within the pocket of a slingbow and being held between a thumb and finger.

FIG. 10 is a diagram of an exemplary slingbow nock installed within the pocket of a slingbow and being held between a thumb and finger. In the illustrated embodiment, a user's thumb 1010 and the folded index finger 1020 are shown as pinching the pocket 960 and the flared element 905 to securely hold the nock 900 during a draw back.

Figure 11:
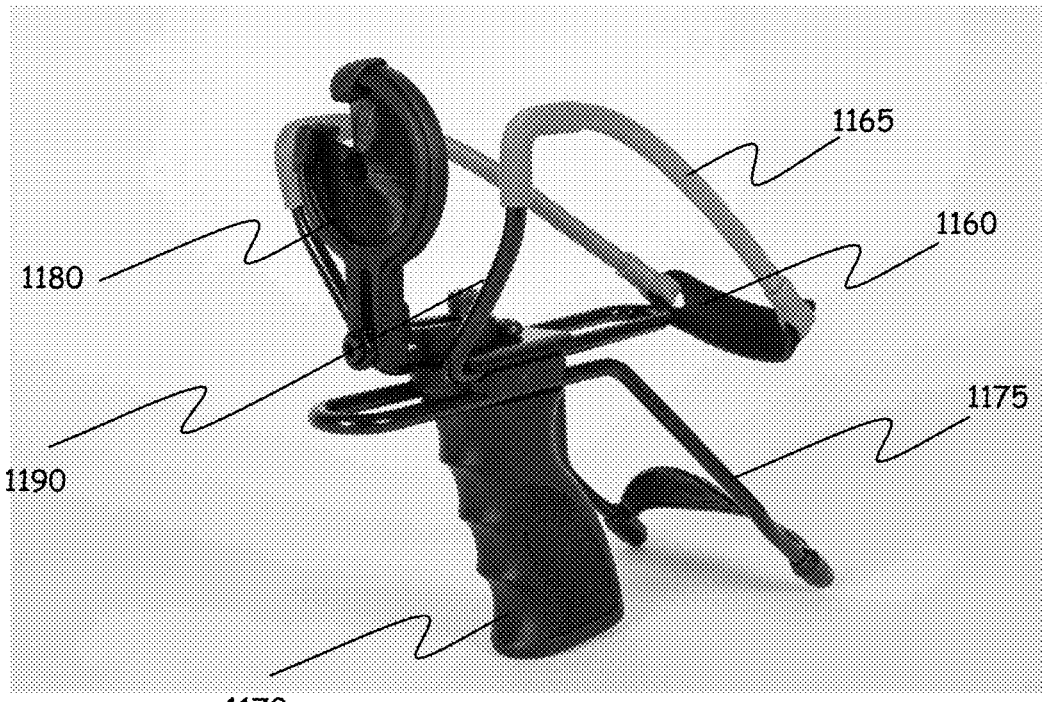
FIG. 11 is an exemplary slingbow.

FIG. 11 is an exemplary slingbow. The slingbow 1100 includes a hand grip 1170 and an arm support 1175. The user grasps the hand grip 1170 and the arm support 1175 rests on the users forearm. The slingbow 1100 includes two arms 1190 that are attached to the hand grip 1170. On the ends of the two arms 1190, elastic bands 1165 are attached and the elastic bands 1165 are attached to the pocket 1160. The elastic bands 1165 are typically formed from vulcanized rubber or elastic. The pocket 1160 may be constructed of leather, plastic, rubber, cloth, etc. An arrow support, such as a whisker biscuit 1180 is connected to the hand grip 1170 between the two arms 1190. As illustrated in FIG. 10, an arrow with an embodiment of the nock can be inserted into the slingbow 1100 by placing the flared element into the pocket 1160 and the shaft of the arrow into the whisker biscuit 1180. The flared element is then pinched by a user as the arrow is drawn back and the bands 1165 stretched. Upon release of the pocket 1160, the arrow is launched.

Figure 12:
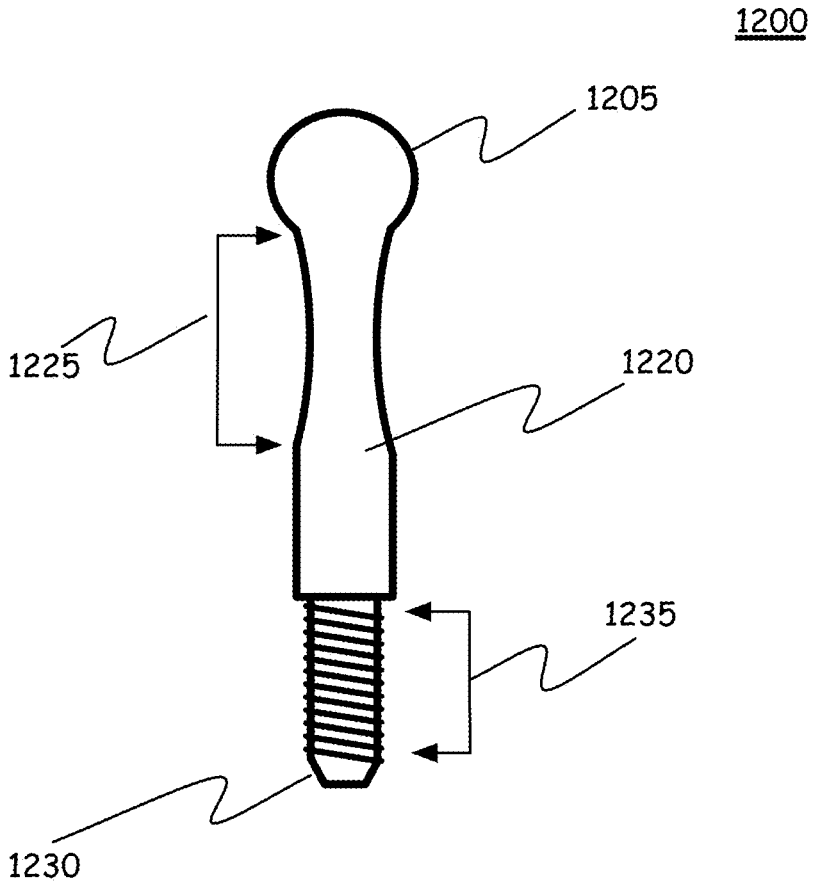
FIG. 12 illustrates yet another embodiment of the slingbow nock.

FIG. 12 illustrates yet another embodiment of the slingbow nock. The illustrated embodiment of the nock 1200 presents features that may be incorporated into any of the previously presented embodiments as well as other anticipated embodiments. In the illustrated embodiment, the flared element 1205 of the nock 1200 is illustrated as being substantially round; however, any of the afore-described shapes and other shapes can be utilized in conjunction with this embodiment. The nock 1200 includes a shank 1220 and a connection shaft 1230. The shank 1220 is illustrated as including a tapering area 1225 in which the diameter of the shank 1220 is reduced proximate to the flared element 1205. Advantageously, this feature enables the flared element 1205 to be reduced in size and thus also operates to reduce the resistance of the flared element 1205 to wind and a whisker biscuit. The illustrated taper 1225 is a curved taper that reduces the diameter of the shank 1220 to a minimum and then curves back to a point proximate to the flared element 1205. In other embodiments, the flare may be linear and/or only taper in one direction rather than tapering to a point and then changing direction.

The connection shaft 1230 is illustrated as including raised ridges in a threaded form. As such, the connection shaft 1230 can be screwed into an arrow shaft that includes an interior thread or, the connection shaft 1230 can be pushed or pushed in a rotating fashion into the shaft of an arrow and the threaded ridges would then be used to hold the nock 1200 in position by friction with the interior surface of the arrow shaft.

It should be appreciated that in some embodiments, an arrow or a bolt may be constructed specifically for slingbow use and thus, the slingbow nock would be manufactured into the arrow or bolt. In such embodiments, the slingbow nock may or may not be removable. Further, the slingbow arrow or bolt may include a dual purpose nock that is suitable for both slingbow usage and/or standard bow or crossbow use.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A nock for a projectile, the nock comprising:

a connection shaft;

a shank that is coaxially aligned with the connection shaft and the connection shaft extends from a first end of the shank; and a flare that extends from a second end of the shank, wherein the second end is distal from the first end;

wherein the shank has a length, wherein the length of the shank is sufficiently long such that it can be held between the fingers;

wherein the flare is configured to operate as a grip stop for holding the projectile, and wherein the flare is further configured to be held in the pocket of a slingbow.

2. The nock of claim 1, wherein the connection shaft has a smaller diameter than the shank and is configured to be inserted into the interior of a projectile shaft.

3. The nock of claim 2, wherein the surface of the connection shaft includes one or more raised surfaces to bind the connection shaft against the interior surface of the projectile shaft.

4. The nock of claim 3, wherein the one or more raised surfaces comprise ridges that extend longitudinally over a significant portion of the length of the connection shaft.

5. The nock of claim 3, wherein the one or more raised surfaces comprise ridges that extend over the surface of the connection shaft in a threading manner.

6. The nock of claim 1, wherein the connection shaft has a diameter configured to allow the connection shaft to be inserted into an interior of a projectile shaft.

7. The nock of claim 6, further comprising a ridge between the connection shaft and the shank to operate as a stop when sliding the connection shaft into the interior of the projectile shaft.

8. The nock of claim 6, wherein the surface of the connection shaft includes one or more raised surfaces to bind the connection shaft against the interior surface of the projectile shaft.

9. The nock of claim 8, wherein the one or more raised surfaces comprise ridges that extend laterally over a significant portion of the length of the connection shaft.

10. The nock of claim 8, wherein the one or more raised surfaces comprise ridges that extend over the surface of the connection shaft in a threading manner.

11. The nock of claim 1, wherein the shank includes a plurality of raised surfaces to provide grip friction.

12. The nock of claim 1, wherein the flare includes a plurality of wings extending in a generally outward direction from the surface of the shank.

13. The nock of claim 1, wherein the flare is tapered out from the surface of the shank.

14. The nock of claim 1, wherein the flare includes a slot configured to receive a traditional bow string.

15. The nock of claim 1, wherein the nock is configured to be attached to the projectile using adhesive.

16. The nock of claim 1, wherein the connection shaft is threaded and mates with a threaded projectile shaft interior or exterior.

17. A projectile including a nock, the projectile comprising:

a projectile shaft with a load at one end of the projectile shaft and a fletching attached proximate to a second end of the projectile;

a nock extending from the second end of the projectile, the nock comprising:

a shank that is coaxially aligned with the projectile shaft and having a length extending beyond the fletching; and a flare that extends from the end of the shank that is distal from the arrow shaft;

wherein the length of the shank is sufficiently long such that it can be held between the fingers;

wherein the flare is configured to operate as a grip stop for holding the projectile, and wherein the flare is further configured to be held in the pocket of a slingbow.

* * * * *